US006672267B2

(12) United States Patent
Souki et al.

(10) Patent No.: US 6,672,267 B2
(45) Date of Patent: Jan. 6, 2004

(54) ENGINE-STARTING APPARATUS HAVING OVERRUNNING CLUTCH

(75) Inventors: Takahiro Souki, Handa (JP); Akira Kato, Anjo (JP); Masaru Kamiya, Toyoake (JP); Keisuke Tani, Kariya (JP); Masahiko Osada, Okazaki (JP)

(73) Assignee: Denso Corporation, Kariya (JP)

( * ) Notice: Subject to any disclaimer, the term of this patent is extended or adjusted under 35 U.S.C. 154(b) by 69 days.

(21) Appl. No.: 10/152,846

(22) Filed: May 23, 2002

(65) Prior Publication Data

US 2002/0195895 A1 Dec. 26, 2002

(30) Foreign Application Priority Data

Jun. 22, 2001 (JP) ..... 2001-189798
Mar. 14, 2002 (JP) ..... 2002-070434

(51) Int. Cl.[7] ..... F02N 17/00

(52) U.S. Cl. ..... 123/179.03; 123/179.4; 74/7 C

(58) Field of Search ..... 123/179.1, 179.3, 123/179.4, 179.22, 179.24, 179.28, 179.29, 179.25; 74/7 C; 192/113.5

(56) References Cited

U.S. PATENT DOCUMENTS 3,640,156 A * 2/1972 Mori et al. ..... 477/93
5,159,856 A * 11/1992 Yoshimura et al. ..... 477/161
5,224,446 A * 7/1993 Okita et al. ..... 123/41.12
5,959,385 A 9/1999 Kato et al.
6,054,776 A * 4/2000 Sumi ..... 290/17
6,090,008 A * 7/2000 Hoshiya et al. ..... 477/84
6,335,573 B1 * 1/2002 Eguchi et al. ..... 290/40 C
6,422,972 B1 * 7/2002 Eguchi ..... 477/107

FOREIGN PATENT DOCUMENTS

JP A 8-319923 12/1996

* cited by examiner

*Primary Examiner*—John Kwon
(74) *Attorney, Agent, or Firm*—Oliff & Berridge, PLC

(57) ABSTRACT

An engine-starting apparatus includes an electric motor and an overrunning clutch that transmits a rotational torque of the electric motor to an internal combustion engine. A coupling speed for re-coupling the clutch for re-cranking the engine while it is still rotating by the inertia is set to a point where an inertial speed of the engine becomes equal to or a little higher than an inertial speed of the electric motor. The electric motor is switched on again when its speed decreases to the coupling speed or lower. In this manner, shocks and noises generated in the re-coupling of the clutch are avoided, and the engine can be smoothly re-cranked while it is still rotating by its inertia.

10 Claims, 5 Drawing Sheets

ENGINE-STARTING APPARATUS HAVING OVERRUNNING CLUTCH

CROSS-REFERENCE TO RELATED APPLICATIONS

This application is based upon and claims benefit of priority of Japanese Patent Applications No. 2001-189798 filed on Jun. 22, 2001 and No. 2002-70434 filed on Mar. 14, 2002, the contents of which are incorporated herein by reference.

BACKGROUND OF THE INVENTION

1. Field of the Invention

The present invention relates to an engine-starting apparatus which is used in a system for automatically stopping an internal combustion engine of an automotive vehicle under predetermined conditions and for re-starting the engine under other predetermined conditions.

2. Description of Related Art

A system (so-called engine-idle stop system), which automatically stops an engine under certain conditions, e.g., when a vehicle temporarily stops at an intersection, and automatically re-starts the engine under predetermined conditions, e.g., when the vehicle is driven again, has been known hitherto. This system contributes to reduction of fuel consumption and reduction of exhaust gas pollution. A starter motor having a jump-in pinion is used in this system, for example. However, this type of starter motor is not able to re-start the engine while the engine is still rotating before it comes to a complete stop. Accordingly, the engine has to be re-started after it comes to a complete stop, resulting in a slow response in re-starting operation. Further, noises caused by re-starting the engine is uncomfortable.

In order to re-start the engine while it is still rotating by its inertia, it is proposed to connect the starter motor via a belt. For example, JP-A-9-172753 proposes a starter motor connected to a crankshaft of an engine via a belt. This starter motor includes an overrunning clutch that prevents the starter motor from being driven by the engine after the engine is cranked up. The overrunning clutch disconnects the starter motor from the engine when the engine reaches a rotational speed exceeding a predetermined speed. However, there is a problem as described below in this system.

When the engine stalls for some reasons after it is once cranked up, the engine speed temporarily increases and then it comes to a rapid stop. At a time when the engine speed temporarily increases, the starter motor is disconnected from the engine by operation of the overrunning clutch, and thereby the rotational speed of the starter motor increases to a speed close to its no-load speed by its inertia. Then, the rotational speed of the starter motor decreases more gradually than the engine speed. This means that the engine speed is higher than the starter motor speed at the beginning, and then the starter motor speed exceeds the engine speed. If the overrunning clutch is engaged at this moment, an engagement shock and noises are generated due to a speed difference between the engine and the starter motor. This may results in breakdown of the overrunning clutch.

SUMMARY OF THE INVENTION

The present invention has been made in view of the above-mentioned problem, and an object of the present invention is to provide such a starting apparatus for use in the so-called engine-idle stop system that is able to smoothly re-start an engine when the engine is still rotating by its inertia while avoiding troubles in re-engagement of an overrunning clutch.

The engine-starting apparatus of the present invention is composed of an electric motor and an overrunning clutch for transmitting the rotational torque of the electric motor to the internal combustion engine and for intercepting torque transmission from the internal combustion engine to the electric motor. The overrunning clutch is composed of a driving member connected to the electric motor, a driven member connected to the internal combustion engine and a coupling member disposed between the driving member and the driven member for coupling and separating the driving member to and from the driven member.

A separating speed of the driving member at which the driving member is separated from the driven member is set to a point where the rotational speed of the driven member exceeds the rotational speed of the driving member. A coupling speed of the driven member at which the driven member is re-coupled to the driving member is set to a predetermined point. The electric motor is switched off at the separating speed and switched on again when the rotational speed of the driven member becomes equal to or lower than the coupling speed.

The coupling speed of the driven member is set to a speed equal to or a little higher than a level where the driven member speed becomes equal to the driving member speed under a situation where the internal combustion engine stalls after it is once cranked and the engine speed decreases more quickly than that of the electric motor. Alternatively, the coupling speed is set to a speed equal to or a little higher than a maximum no-load speed of the electric motor. Preferably, the coupling speed is set to a speed lower than the separating speed to avoid repetition of separating and re-coupling operation of the overrunning clutch. Either the separating speed or the coupling speed, or both may be set to a speed lower than a level at which a film for lubricating the coupling member is disconnected.

By switching on the electric motor again when the driven member speed decreases to the coupling speed or lower, shocks and noises otherwise generated at the re-coupling of the overrunning clutch can be avoided, and the internal combustion engine can be smoothly re-started while it is still rotating by its inertia. More particularly, under a situation where the engine stalls after it is once cranked, the engine can be smoothly re-cranked while it is still rotating by the inertia. Under a situation where the engine is automatically stopped at an intersection, it can be smoothly re-cranked without waiting until it comes to a complete stop. A time required for re-cranking the engine is shortened and the re-coupling shocks and damages to the clutch are avoided at the same time.

Other objects and features of the present invention will become more readily apparent from a better understanding of the preferred embodiment described below with reference to the following drawings.

DETAILED DESCRIPTION OF THE PREFERRED EMBODIMENT

Figure 1:
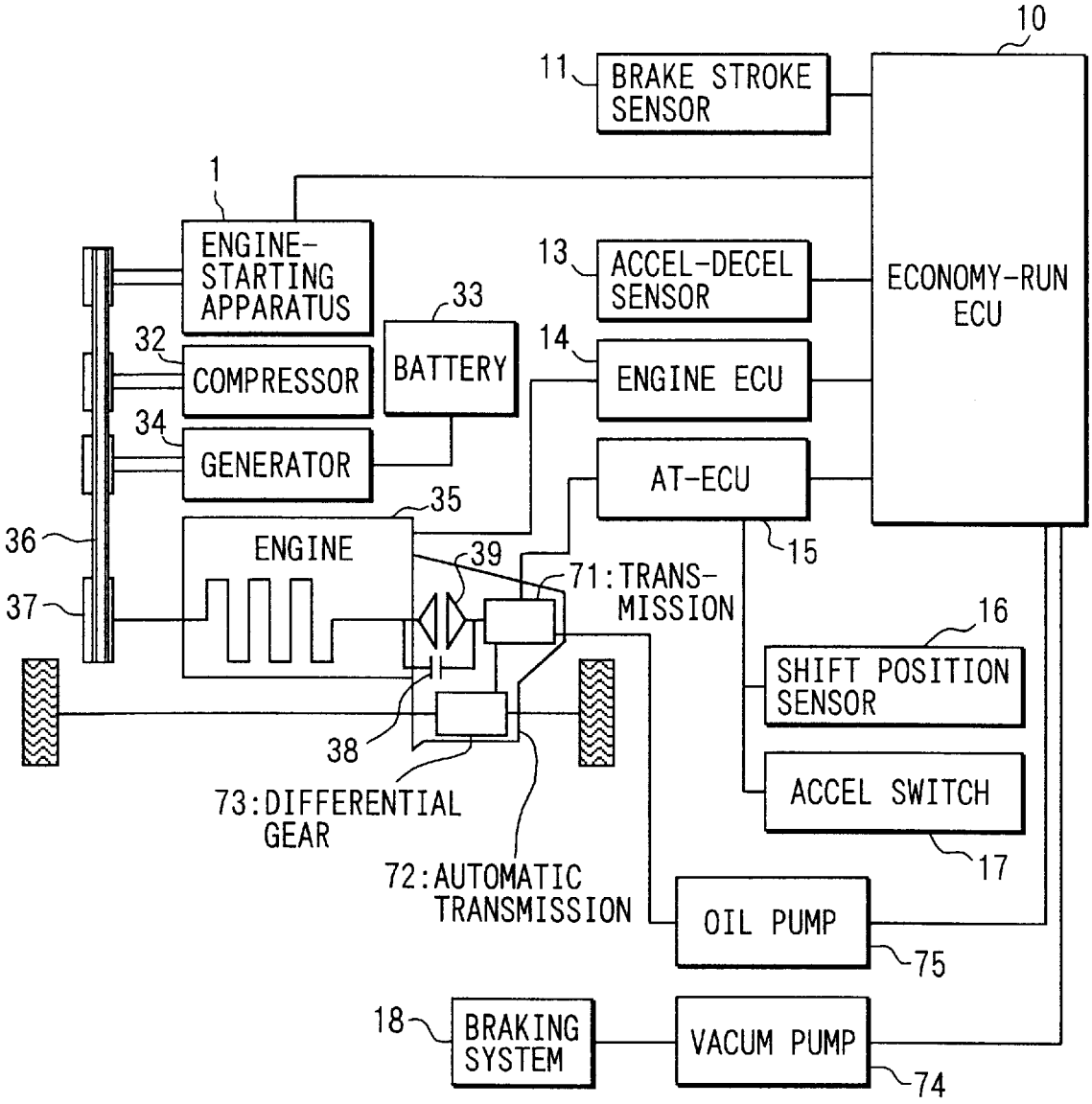
FIG. 1 is a block diagram showing an entire structure of a system in which an engine-starting apparatus of the present invention is used.

A preferred embodiment of the present invention will be described with reference to accompanying drawings. First, referring to FIG. 1, an entire engine control system in which an engine-starting apparatus of the present invention is used. A pulley 37 is connected to a crankshaft of an internal combustion engine 35. An engine-starting apparatus 1 according to the present invention is connected to the pulley 37 via a belt 36 together with a generator 34 for charging a battery 33 and a compressor 32 for an air-conditioner. An output shaft of the engine 35 is connected to a driving axle through an automatic transmission 72 that includes a torque converter 39, a transmission 71, a lock-up clutch 38 and a differential gear 73.

An economy-run ECU 10 (an electronic control unit) for controlling an engine-idle stop system is connected to various ECUs. The economy-run ECU 10 includes: CPUs for controlling various devices; ROMs storing various data and programs; RAMs to which data obtained in calculation processes and various flags are written; A-D converters for converting analog input signals to digital signals; input-output interfaces (I/O); timers; bass lines for connecting those components; and so on. Control processes shown in FIGS. 4 and 5, which will be explained later, are performed according to the programs stored in the ROMs.

As shown in FIG. 1, the following devices and ECUs are connected to the economy-run ECU 10: a brake stroke sensor 11 for detecting an amount of a brake pedal stroke; an acceleration-deceleration sensor 13 for detecting acceleration and deceleration of a vehicle; an engine ECU 14 for controlling engine operation; AT-ECU 15 for controlling the automatic transmission; an electric oil pump 75 for supplying operating oil required while the engine is not operating to the automatic transmission; and an electric vacuum pump 74 for generating negative pressure required during a period in which the engine is not operating and for supplying the negative pressure to a brake system 18. The economy-run ECU 10 is structured to automatically stop and re-start the engine 35 based on acceleration-deceleration conditions of the vehicle, braking operation by a driver, and operating conditions of the engine 35 and the automatic transmission 71.

A sensor for detecting rotational speed of the engine, an intake manifold pressure sensor for detecting the pressure in an intake manifold and other sensors (those are not shown in FIG. 1) are connected to the engine ECU 14. The engine ECU 14 controls operation of an ignition system and a fuel injection system, under a predetermined program, according to information fed from the various sensors. A shift-position sensor 16 for detecting transmission gear positions, an accelerator switch 17 for detecting whether an accelerator pedal is operated or not, and other sensors are connected to the AT-ECU 15. The AT-ECU 15 controls operation of the automatic transmission 72.

Since the engine-starting apparatus 1 is connected to the crankshaft pulley 37 via a belt 36, it is possible to re-start the engine during a period in which the engine is still rotating by its inertia after the ignition switch is turned off. In other words, it is not necessary to wait for a complete stop of the engine for re-starting the engine.

Figure 2A:
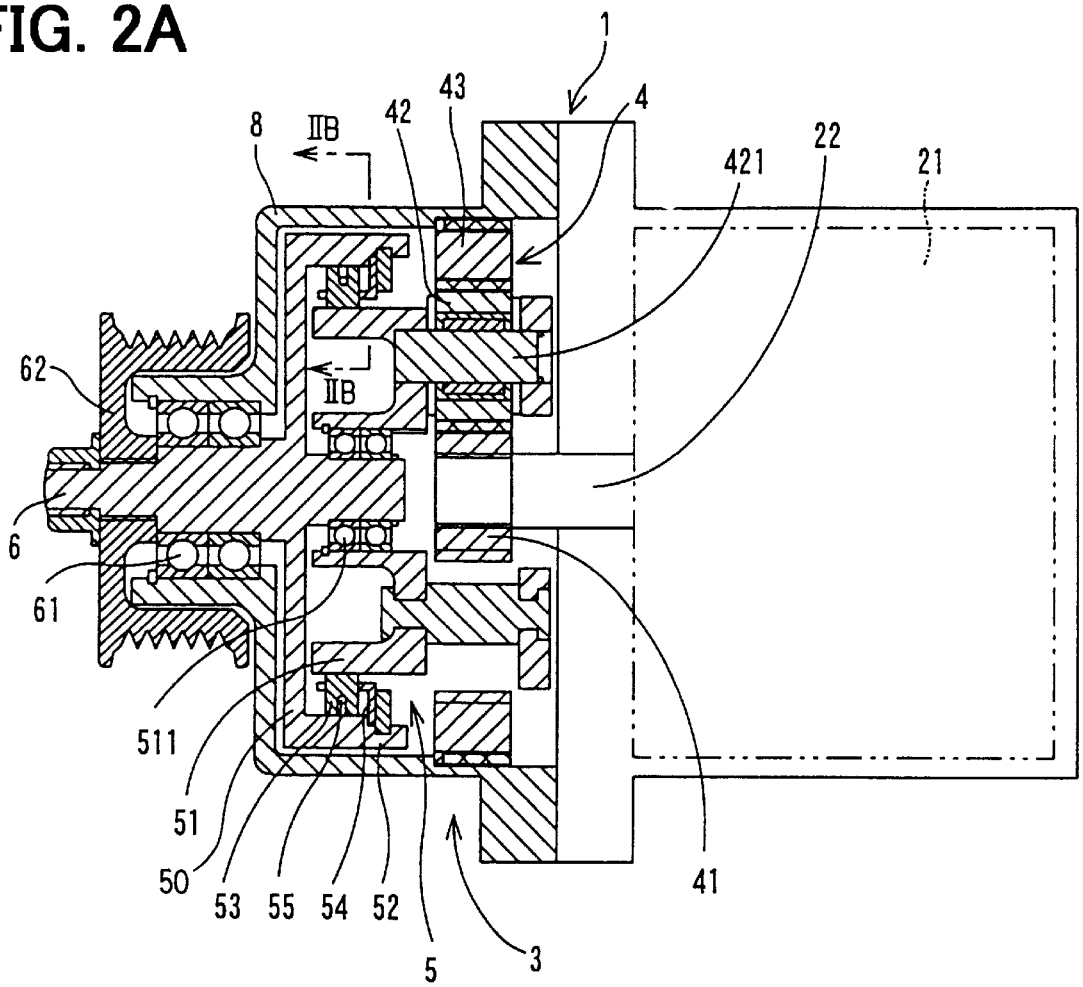
FIG. 2A is a cross-sectional view showing the engine-starting apparatus according to the present invention.
Figure 2B:
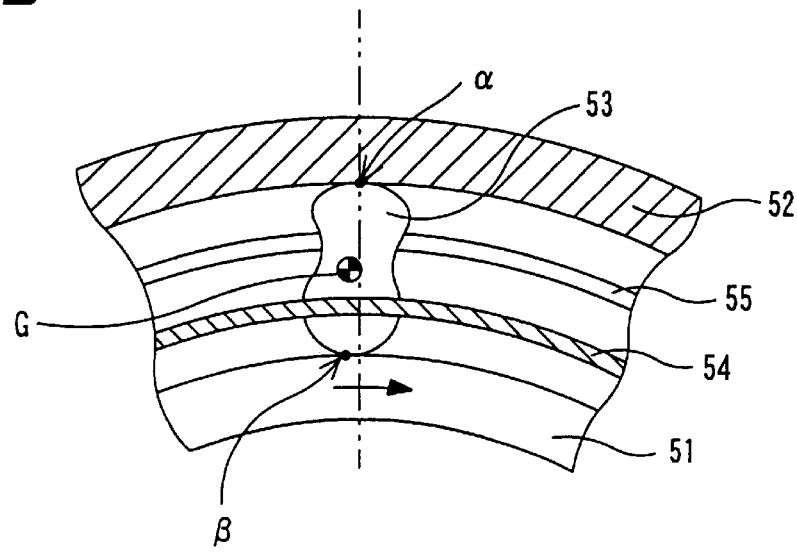
FIG. 2B is a cross-sectional view showing a part of the engine-starting apparatus, taken along line IIB—IIB shown in FIG. 2A.

Now, referring to FIGS. 2A and 2B, the engine-starting apparatus 1 will be described in detail. The engine-starting apparatus 1 is substantially composed of an electric motor 21 and a torque-transmitter 3. The electric motor 21 is a known direct current motor, details of which will not be explained. The torque-transmitter 3 is composed of a speed reducer 4 and an overrunning clutch 5, both contained in a housing 8 in tandem.

The speed reducer 4 is a planetary gear composed of a sun gear 41, pinion gears 42 and a ring gear 43. The sun gear 41 is fixed to an output shaft 22 of the electric motor 21, and the ring gear 43 is fixed to an inner periphery of the housing 8. The pinions 42 disposed between the sun gear 41 and the ring gear 43 are driven in the following manner. When the sun gear 41 rotates clockwise, for example, each pinion 42 rotatably supported by a carrier 421 rotates counter-clockwise. Since the ring gear 43 is fixed to the housing 8, the carrier 421 having pinions 42 thereon rotates clockwise around the sun gear 41, while each pinion 42 itself rotating counter-clockwise around the carrier shaft 421. This means that rotation of the output shaft 22 of the electric motor 21 is converted into rotation of the carrier 421. Since the carrier 421 rotates less than one rotation while the sun gear 41 connected to the output shaft 22 of the electric motor 21 makes one rotation, the planetary gear functions as a speed reducer as a whole.

The overrunning clutch 5 is substantially composed of a shaft 6, a cup 50 integrally connected to the shaft 6, and an inner ring 51 rotatably supported on the shaft 6 via a bearing 511. The shaft 6 is rotatably supported by the housing 8 via a bearing 61, and a pulley 62 is fixedly connected to the shaft 6. The pulley 62 is coupled to the engine crankshaft pulley 37 via a belt 36 such as a V-belt, as shown in FIG. 1. The inner ring 51 is connected to the carrier 421 so that the inner ring 51 is rotated by the carrier 421.

The cup 50 of the overrunning clutch 5 includes an outer ring 52 which is coupled to the inner ring 51 by operation of a coupler disposed therebetween. The overrunning clutch 5 constitutes an one-way clutch that transmits the rotational torque of the inner ring 51 to the outer ring 52, while preventing torque transmission from the outer ring 52 to the inner ring 51. As shown in FIG. 2B, the coupler is composed of sprags 53 disposed between the inner ring 51 and the outer ring 52, a holder 54 for holding the sprags 53 and a garter spring 55 for biasing the sprags 53 in a direction to couple the outer ring 52 and the inner ring 51.

The holder 54 is shaped in a cylinder having a flange at one side and includes holes (not shown) for loosely holding the sprags 53 therein. The holder 54 is fixed to the outer ring 52. The sprag 53 is gourd-shaped, and the garter spring 55 is inserted in a groove formed in an outer half portion of the gourd-shaped sprag 53. The sprags 53 are positioned at their initial positions by the basing force of the garter spring 55. At the initial position, the sprag 53 contacts the inner periphery of the outer ring 52 at point $\alpha$ and contacts the outer periphery of the inner ring 51 at point β, as shown in FIG. 2B. The posture of the sprag 53 at its initial position changes when forces other than the biasing force of the garter spring 55 are applied thereto. That is, the sprag 53 rotates counter-clockwise when the inner ring 51 rotates clockwise, thereby coupling the inner ring 51 to the outer ring 52. On the other hand, the sprag 53 rotates clockwise when the rotational torque of the outer ring 52 exceeds the rotational torque of the inner ring 51, thereby separating the inner ring 51 from the outer ring 52. The sprag 53 is designed so that its gravity center G is positioned off-line with respect to a line connecting the point α and its rotational center, as shown in FIG. 2B.

Now, operation of the engine-starting apparatus 1 will be described. When the electric motor 21 is rotated by supplying electric current thereto, the sun gear 41 connected to the output shaft 22 of the electric motor 21 rotates. The carrier 421 carrying the pinions 42 thereon rotates around the sun gear 41, and thereby the inner ring 51 of the overrunning clutch 5 is rotated by the carrier 421 around the shaft 6. It is presumed, for explanation purpose, that the inner ring 51 rotates clockwise viewed from the motor side, as shown in FIG. 2B. When the inner ring 51 rotates clockwise, the sprag 53 swings in a counter-clockwise direction by the frictional force. The sprag 53 takes an upright position between the inner ring 51 and the outer ring 52, coupling the inner ring 51 to the outer ring 52 thereby to transmit the rotational torque of the inner ring 51 to the outer ring 52. Thus, the rotational torque of the electric motor 21 is transmitted to the pulley 62 via the speed reducer 4 and the overrunning clutch 5. The rotational torque of the pulley 62 is transmitted to the engine crankshaft pulley 37 via the belt 36 to crank up the engine 35. Under this situation, the rotational speed of the inner ring 51 and the outer ring 52 are the same because both rings are coupled.

When the engine 35 is cranked up and rotates by itself, the rotational speed of the outer ring 52 exceeds that of the inner ring 51. As a result, the outer ring 52 rotates clockwise relative to the inner ring 51, and the sprag 53 swings in a clockwise direction (from the upright posture toward the flat posture), thereby disconnecting the coupling between both rings 51, 52. Thus, the rotational torque of the engine 35 is not transmitted to the electric motor 21. Thereafter, as the engine speed further increases, a centrifugal force is applied to the sprag 53. Since the gravity center of the sprag 53 is positioned behind the line connecting the contact point α and the center of the sprag 53, as shown in FIG. 2B, the posture of the sprag 53 becomes flatter due to the centrifugal force. At this point, the sprag 53 which has been slidably contacting the inner ring 51 becomes afloat and is completely separated from the inner ring 51. The rotational speed of the inner ring 51 at which the sprag 53 becomes afloat is defined as a separating speed Rs. The sparg 53 is loosely held by the holder 54 so that the sprag 53 can move in the manner described above.

When the sprag 53 is completely separated from the inner ring 51, no load is applied to the electric motor 21. Accordingly, the electric motor 21 increases its speed up to a speed which can be attainable under no load. The electric motor 21 is switched off at this point because it is determined that the engine is successfully cranked up. Accordingly, the rotational speed of the inner ring 51 connected to the electric motor 21 gradually deceases. On the other hand, if the engine stalls after the cranking operation, the engine speed rapidly decreases.

Figure 3A:
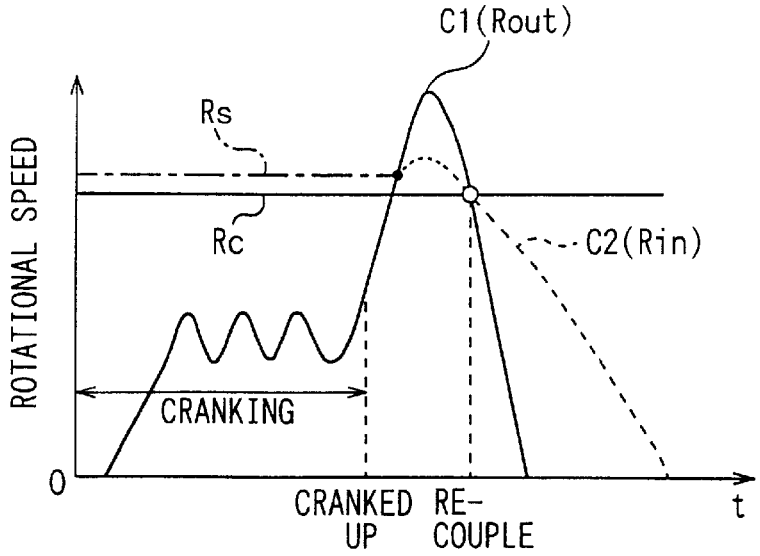
FIG. 3A is a graph showing rotational speeds of an outer ring and an inner ring of an overrunning clutch versus time lapsed after an electric motor is switched on, wherein a first example in setting a coupling speed of the overrunning clutch is illustrated.
Figure 3B:
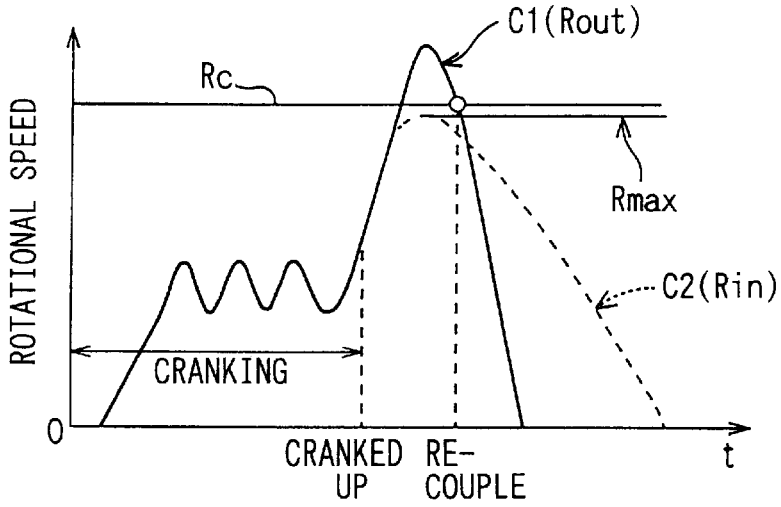
FIG. 3B is a graph showing a similar graph as in FIG. 3A, wherein a second example in setting the coupling speed of the overrunning clutch is illustrated.
Figure 3C:
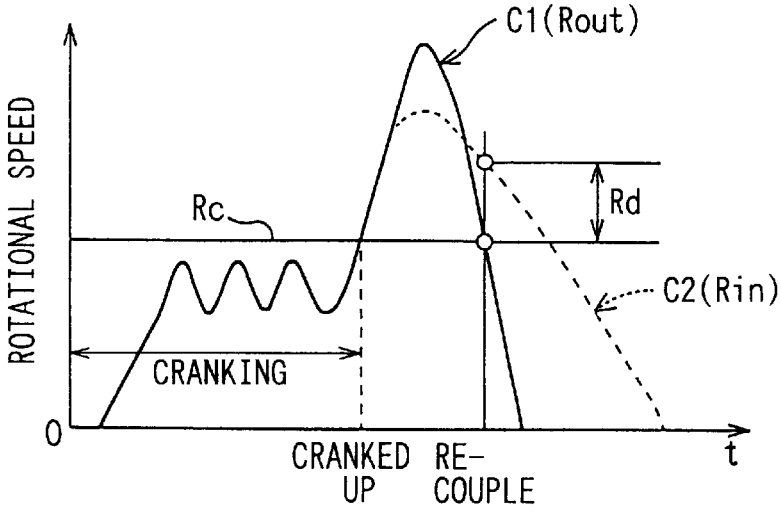
FIG. 3C is a graph showing a similar graph as in FIG. 3A, wherein the coupling speed of the overrunning clutch is set to a lower level than that shown in FIG. 3A.

The rotational speed of the engine 35 and the rotational speed of the electric motor 21 under the situation where the engine stalls after the cranking operation are shown in FIGS. 3A–3C. The rotational speed Re of the engine 35 is represented by the rotational speed Rout of the outer ring 52 because both speeds are proportional to each other. Similarly, the rotational speed Rm of the electric motor 21 is represented by the rotational speed Rin of the inner ring 51 because both speeds are proportional to each other. In the graphs shown in FIGS. 3A–3C, both speeds Rout and Rin are shown, assuming no torque is transmitted therebetween after the engine stalls, for making the following explanation simple. In those graphs, the outer ring speed Rout is shown by a first curve C1, and the inner ring speed Rin is shown by a second curve C2. As seen in those graphs, the outer ring speed Rout decreases more rapidly than the inner ring speed Rin when the engine stalls.

If the outer ring speed Rout decreased as shown in the graphs, the sprag 53 being afloat contacts again the outer periphery of the inner ring 52, and the torque transmission between both rings 51, 52 resumes. The outer ring speed Rout at which the torque transmission is resumed is defined as a coupling speed Rc. The outer ring speed Rout is lower than the coupling speed when the engine is being cranked. After the engine is cranked up, there is no torque transmission is needed. Therefore, it is conceivable to set the coupling speed Rc at a level a little higher than the outer ring speed Rout in the cranking operation, as shown in FIG. 3C. However, if the coupling speed Rc is set to this level, there is the following problem. Since the outer ring speed Rout decreases more quickly than the inner ring speed Rin, the inner ring speed Rin is higher than the outer ring speed Rout when the outer ring speed Rout decreases to the level of the coupling speed Rc, as shown in FIG. 3C. That is, there exists a rotational speed difference Rd between the inner ring 51 and the outer ring 52. If the torque transmission is resumed under this situation, a large engagement shock and noises are generated, and the overrunning clutch 5 may be damaged, or broken in the worst case.

In order to reduce the shock generated when the outer ring 52 is re-coupled to the inner ring 51, the coupling speed Rc has to be properly set. One example of setting the coupling speed Rc is shown in FIG. 3A, and the other example is shown in FIG. 3B. In FIG. 3A, curve C1 shows the rotational speed Rout of the outer ring 52 (representing the engine speed Re) versus time lapsed after the electric motor 21 is switched on under the situation where the engine 35 stalls after the cranking operation. Curve C2 shows the rotational speed Rin of the inner ring 51 (representing the rotational speed of the electric motor Re) versus time lapsed after the electric motor 21 is switched off at the separating speed Rs under the same situation, assuming no torque transmission occurs between both rings 51, 52. In other words, the curve C2 shows the rotational speed of the inner ring 51 when the electric motor 21 is rotating by its inertia under no load.

In the first example shown in FIG. 3A, the coupling speed Rc is set to a point where the curve C1 crosses the curve C2. In other words, the coupling speed is set to a point where the outer ring speed Rout becomes equal to the inner ring speed Rin. Since the outer ring speed Rout decreases more rapidly than the inner ring speed Rin, as mentioned above, the crossing pint of the tow curves C1 and C2 exists under the situation where the engine stall occurs. By setting the coupling speed Rc in this manner, the re-coupling shock is not generated because the inner ring speed Rin and the outer ring speed Rout are equal to each other at the time when the overrunning clutch 5 is re-coupled.

It is also possible to set the coupling speed Rc at a level a little higher than the crossing point of two curves C1 and C2. In this case, the outer ring speed Rout is higher than the inner ring speed Rin at the time of re-coupling. Under this situation, the sprags 53 are not at the upright positions but they are sliding on the outer surface of the inner ring 51. Therefore, the re-coupling can be smoothly attained without causing the re-coupling shock.

By setting the coupling speed Rc at the crossing point of the curves C1 and C2, or a little higher than that, the re-coupling shock is prevented. If a large re-coupling shock were generated, it would be necessary to increase the number of sprags 53 to reduce a load applied to each sprag 53, or to enlarge a width of each sprag 53 to reduce a surface pressure applied thereto. It is not necessary to take such measures by setting the coupling speed Rc in the manner described above. Under the situation where the engine stall occurred, the electric motor 21 is turned on again when the engine speed Re represented by the outer ring speed Rout deceases to the level of the coupling speed Rc. In this manner, the engine 35 can be smoothly re-started without waiting until the engine 35 comes to a complete stop. In other words, a time required for re-starting the engine 35 is shortened.

The coupling speed Rc can be adjusted by changing the weight or the shape of the sprag 53, or by changing the biasing force of the garter spring 55. Therefore, if adjustment of the coupling speed Rc is required according to types of engines, such adjustment can be easily made by modifying only the garter spring 55 without changing the sprag 53. Further, such adjustment may be made by only changing the length of the garter spring 55 without changing the material thereof, and thereby reducing the manufacturing cost.

Since the plural sprags 53 are disposed between the inner ring 51 and the outer ring 52, all sprags 53 may not take the exactly same posture at a given speed because of a possible manufacturing dispersion in their size and weight. If it is defined that the re-coupling occurs when only one or two sprags 53 contact the outer periphery of the inner ring 51, torque transmission at the re-starting has to be borne by the few number of sprags 53. This may results in damaging or breaking-down the overrunning clutch 5. To avoid such a situation, the coupling speed Rc is defined as the outer ring speed Rout at which a sufficient number of sprags 53 to transmit the rotational torque contact the inner ring 51. Similarly, the separating speed Rs is defined as the inner ring speed Rin at which a certain number of sprags 53 are separated from the inner ring 51. The sufficient number of the sprags 53 to transmit the rotational torque differs depending on the physical structure or the material of the sprag 53. Five sprags out of ten, for example, may be sufficient in a certain case, or 8 or 9 may be required in another case. The certain number of sprags for defining the separating speed may be set to all of the sprags used.

The overrunning clutch 5 is lubricated by lubricant contained therein. If the lubricant becomes short, the overrunning clutch 5 may cause seizing that makes it difficult to release the coupling of the clutch. To avoid such a situation, it may be effective to set either of the separating speed Rs or the coupling speed Rc to a level lower than the rotational speed at which the lubricating film becomes disconnected.

There is a possibility that the coupling and the separation of the clutch are repeated at a low engine speed when the engine is being started or stopped. To avoid the repetition of ON and OFF of the overrunning clutch 5, it is preferable to set the separating speed Rs and the coupling speed Rc with a certain hysteresis, as shown in FIG. 3A. That is, the separating speed Rs is set to a level higher than the coupling speed Rc. In this manner, the repetitive operation of the overrunning clutch 5 can be avoided, and the shock occurring at the clutch operation is alleviated. The hysteresis may be provided by adjusting the predetermined number of sprags 53 for determining the separating speed Rs and the coupling speed Rc. For example, the separating speed Rs may be defined as a speed at which all the sprags 53 used in the clutch are separated, and the coupling speed Rc may be defined as a speed at which a certain number of sprags 53 sufficient to transmit the rotational torque contact the inner ring 51. Alternatively, it may be possible to provide the hysteresis between the separating speed Rs and the coupling speed Rc by adjusting viscosity or amount of the lubricant such as oil or grease contained in the clutch.

Now, referring to FIG. 3B, the second example of setting the coupling speed Rc will be described. In this example, the coupling speed Rc is set to a level equal to the maximum no-load speed of the inner ring 51 or a little higher than that level. In the first example described above, the crossing point of the curve C1 and the curve C2 that determines the coupling speed Rc may not be at the same rotational speed for every engine, because the shape of the curve C1 somewhat differs from engine to engine. In the second example, the maximum no-load speed (the maximum inner ring speed Rin) that determines the coupling speed Rc does not depend on the engine. Accordingly, the coupling speed Rc is common to all the engines, and the same overrunning clutch 5 can be commonly applicable to all the engines. The manufacturing cost of the overrunning clutch 5 can be reduced by commonly using the same overrunning clutch 5.

Since the coupling speed Rc is set to a level equal to the maximum no-load speed of the inner ring 51 or a little higher than that level in the second example, the outer ring speed Rout is equal to the inner ring speed Rin or a little higher than that when the clutch is re-coupled. Therefore, no shock is generated at the time of re-coupling.

Figure 4:
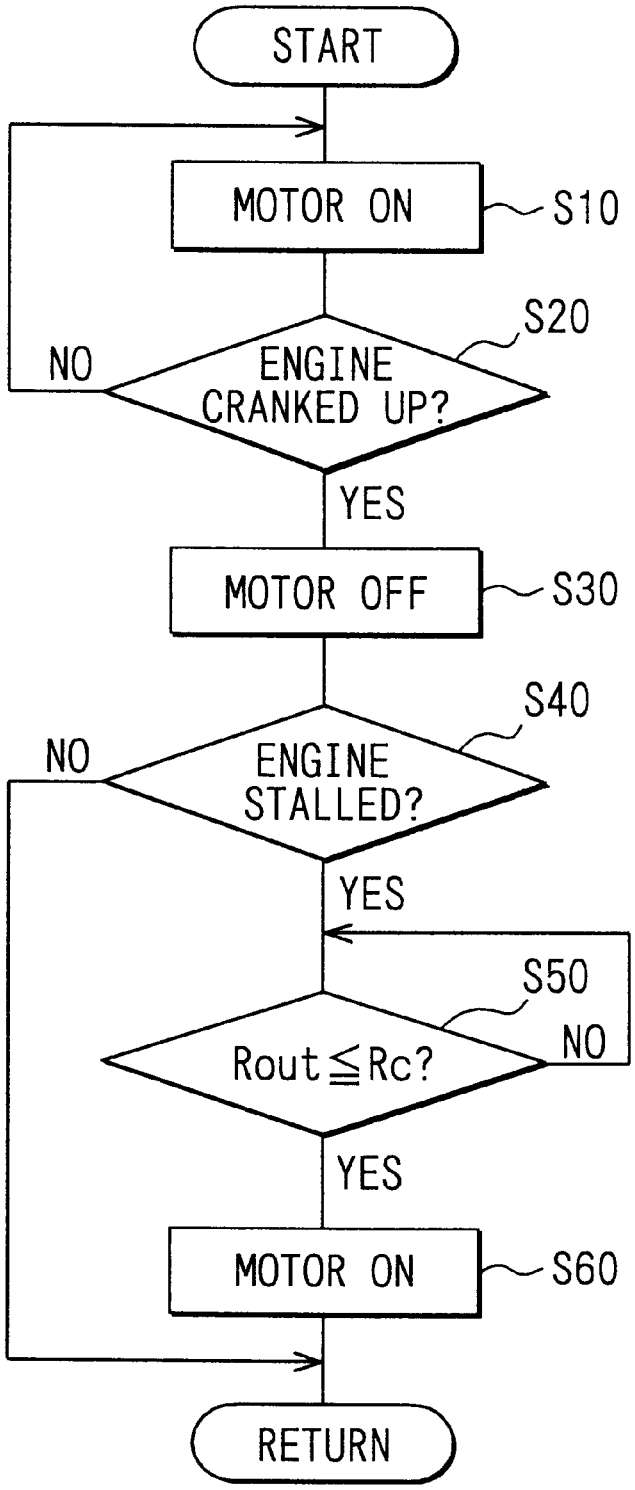
FIG. 4 is a flowchart showing a process of re-starting an engine when the engine stalls after it is once cranked up.

A process for controlling the engine-starting apparatus 1, which is performed by the economy-run ECU 10 shown in FIG. 1, will be described referring to FIGS. 4 and 5. FIG. 4 shows the process for starting the engine which is at a complete stop and for re-starting the engine which stalls after cranking operation. At step S10, the electric motor 21 is switched on. At step S20, whether the engine is started or not is determined. This determination can be made based on the rotational speed of the electric motor 21. If the engine is cranked up, its speed reaches the separating speed Rs at which the overrunning clutch 5 is disconnected. Upon disconnection of the overrunning clutch 5, the electric motor 21 becomes no-load operation, and its speed reaches the maximum no-load speed. Therefore, it can be determined that the engine is started when the motor speed reaches its maximum no-load speed.

If it is determined that the engine is started at step S20, the process proceeds to step S30 where the electric motor 21 is switched off. If not, the process returns to step S10. Then, at step S40, whether the engine stalled or not is determined base on information from the engine ECU 14. If the engine did not stall, the process comes to the end. If the engine stalled, the process proceeds to step S50, where whether the engine speed represented by the outer ring speed Rout has decreased to the level of the coupling speed Rc or lower is determined. For this purpose, the engine speed detected for use in the engine ECU 14 may be used instead of directly detecting the outer ring speed Rout. If the outer ring speed Rout representing the engine speed has decreased to the coupling speed Rc or lower, the process proceeds to step S60, where the electric motor 21 is switched on again. Since the inner ring 51 is coupled to the outer ring 52 via the sprags 53 at this point, the engine can be re-started by switching on the electric motor 21.

Figure 5:
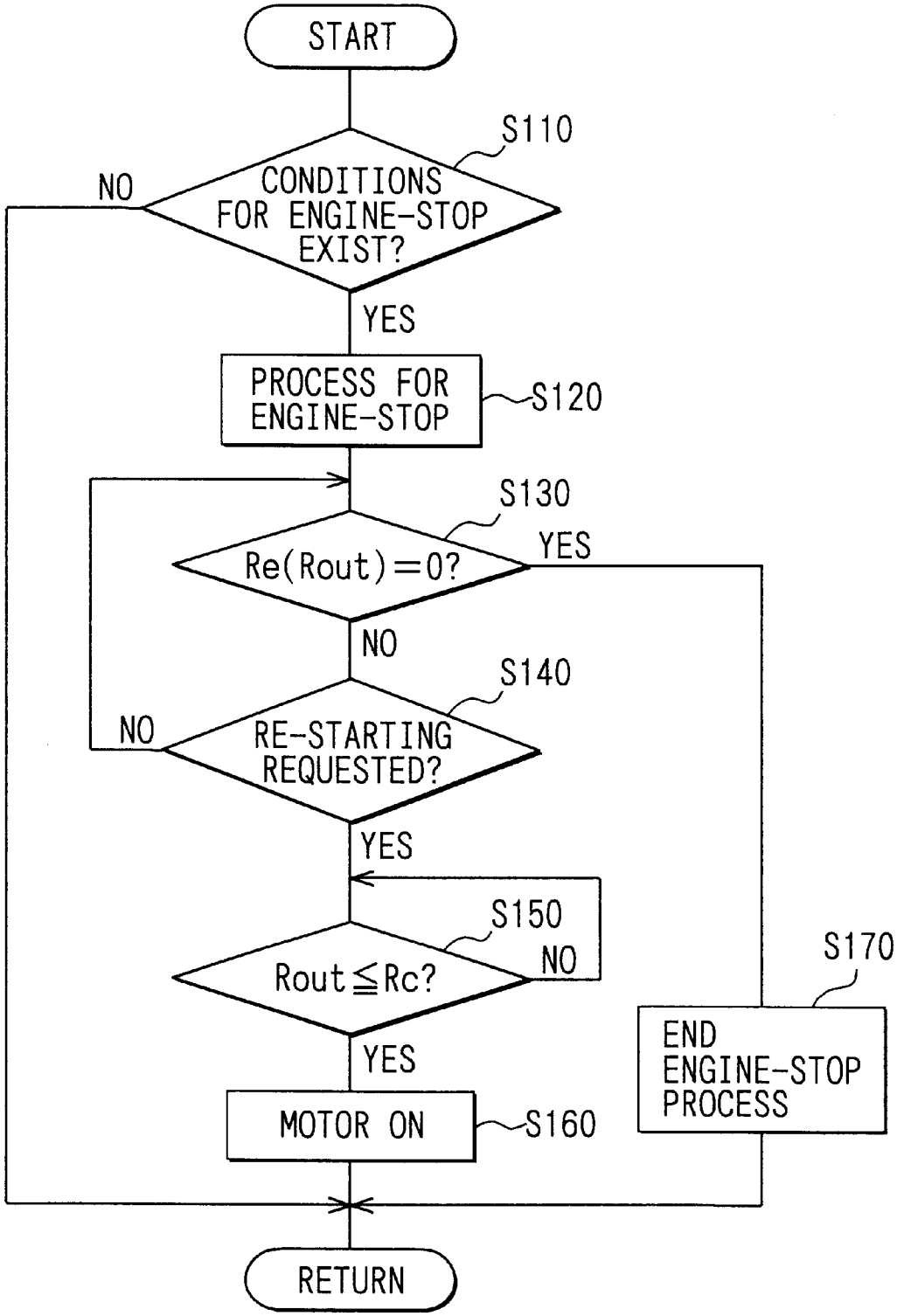
FIG. 5 is a flowchart showing a process of re-starting the engine when the engine is still rotating by its inertia.

FIG. 5 shows a process for re-starting the engine while it is still rotating by its inertia after it has been automatically stopped. At step S110, whether conditions for automatically stopping the engine exist is determined. The conditions includes, for example, a vehicle speed and a stroke of a braking pedal. If the vehicle speed is zero and the braking pedal stroke is larger than 15% of a full stroke, it is determined that the conditions for automatically stopping the engine exist. If it is determined that the engine stopping conditions do not exit, the process comes to the end. If those conditions exist, the process proceeds to step S120, where the engine is automatically stopped by cutting off fuel injection and ignition.

Then, at step S130, whether the engine speed Re is zero or not is determined. At step S140, whether re-starting of the engine is requested or not while the engine is still rotating by its inertia is determined. If it is determined that the engine speed Re is zero at step S130, the process comes to the end through step S170 at which the automatic engine stopping process is terminated. If it is determined that the engine re-starting is requested at step S140, the process proceeds to step S150, where whether the outer ring speed Rout representing the engine speed Re has decreased to a level equal to or lower than the coupling speed Rc is determined. If the outer ring speed Rout becomes equal to or lower than the coupling speed Rc, the process proceeds to step S160, where the electric motor 21 is switched on again to re-start the engine. The engine can be smoothly cranked up and re-started because the inner ring 51 is coupled to the outer ring 52 via sprags 53 at this point. Then, the process comes to the end. If it is determined that the engine restarting is not requested while the engine is still rotating at step S140, the process returns to step S130. Thereafter, the steps S130 and S140 are repeated.

It is also possible to manually operate the engine-starting apparatus of the present invention. A driver turns on an ignition key to crank up the engine, and turns the ignition key to a position to switch off the starter motor after the driver confirms that the engine has been started. However, if the engine stalls immediately after the starter motor is switched off for some reasons, the driver cranks up the engine again by operating the ignition key. When the starter motor is switched on again while the engine is still rotating by its inertia, the problem described with reference to FIG. 3C will arise if the coupling speed Rc is set to a level lower than the cross-point of the curve C1 and the curve C2. That is, the overrunning clutch may be damaged due to a shock caused by the rotational speed difference Rd between the outer ring 52 and the inner ring 51.

Since the coupling speed Rc is set to the level equal to or higher than the cross-point of the curves C1 and C2 as described above, the overrunning clutch is not damaged by the re-engagement shock even if the starter motor is manually switched on when the engine is still rotating. Similarly, the overrunning clutch can be prevented from being damaged by setting the coupling speed Rc at a level equal to or higher than the maximum no load speed of the inner ring 51, as described above.

In the embodiment described above, the inner ring 51 of the overrunning clutch 5 functions as a driving member in the clutch 5, and the outer ring 52 functions as a driven member in the clutch 5. The outer periphery of the inner ring 51 functions as a torque-transmitting surface, and the inner periphery of the outer ring 52 functions as a torque-receiving surface. The sprags 53 function as a member for coupling the inner ring 51 to the outer ring 52, and the garter spring 55 functions as a member for biasing the sprags 53 to their original positions.

The overrunning clutch 5 used in the embodiment described above may be replaced with other types of clutches, or modified to other forms. For example, the gourd-shaped sprag 53 may be modified to other forms, and the garter spring 55 may be replaced with other biasing members. Though the engine-starting apparatus 1 in the embodiment described above is composed of the electric motor 21, the speed reducer 4 and the overrunning clutch 5, all structured in a single unit, this structure may be variously modified. For example, the overrunning clutch 5 may be integrally installed in the pulley 62 connecting the engine-starting apparatus 1 to the crankshaft pulley 37 via the belt 36. The shaft 6 of the engine-starting apparatus 1 may be directly connected to the crankshaft of the engine 35. Further, the overrunning clutch 5 may be separated from the engine-starting apparatus 1 and installed in the crankshaft pulley 37.

While the present invention has been shown and described with reference to the foregoing preferred embodiment, it will be apparent to those skilled in the art that changes in form and detail may be made therein without departing from the scope of the invention as defined in the appended claims.

What is claimed is:

1. An engine-starting apparatus comprising:

an electric motor; and an overrunning clutch having a driving member connected to the electric motor and a driven member connected to an internal combustion engine, the driving member and the driven member being adapted to be coupled to transmit a rotational torque of the electric motor to the internal combustion engine and to be separated to intercept torque transmission from the internal combustion engine to the electric motor, both members being adapted to be switched from a separated state to a coupled state at a coupling speed and from the coupled state to the separated state at a separating speed, wherein:

the coupling speed is set to a speed equal to or higher than a level at which the rotational speed of the driven member becomes equal to the rotational speed of the driving member under a situation where the internal combustion engine stalls after a cranking operation by the engine-starting apparatus and the rotational speed of the driven member decreases more quickly than that of the driving member in a course of the engine stall.

2. An engine-starting apparatus comprising:

an electric motor; and an overrunning clutch having a driving member connected to the electric motor and a driven member connected to an internal combustion engine, the driving member and the driven member being adapted to be coupled to transmit a rotational torque of the electric motor to the internal combustion engine and to be separated to intercept torque transmission from the internal combustion engine to the electric motor, both members being adapted to be switched from a separated state to a coupled state at a coupling speed and from the coupled state to the separated state at a separating speed, wherein:

the coupling speed is set to a speed equal to or higher than a no-load maximum speed of the driving member which can be attained after the internal combustion engine has been started.

3. An engine-starting apparatus comprising:

an electric motor; and an overrunning clutch having a driving member connected to the electric motor and a driven member connected to an internal combustion engine, the driving member and the driven member being adapted to be coupled to transmit a rotational torque of the electric motor to the internal combustion engine and to be separated to intercept torque transmission from the internal combustion engine to the electric motor, both members being adapted to be switched from a separated state to a coupled state at a coupling speed and from the coupled state to the separated state at a separating speed, wherein:

either one of the coupling speed or the separating speed, or both are set to a speed lower than a level at which a lubricating film of lubricant contained in the overrunning clutch becomes disconnected.

4. The engine-starting apparatus as in any one of claims 1–3, wherein:

the separating speed is set to a level higher than the coupling speed to provide a hysteresis between the separating speed and the coupling speed.

5. The engine-starting apparatus as in any one of claims 1–3, wherein:

the overrunning clutch includes a coupling member disposed between the driving member and the driven member and a biasing member for biasing the coupling member to a position to couple the driving member to the driven member; and the separating speed is set to a rotational speed of the driving member at which a centrifugal force applied to the coupling member balances a biasing force of the biasing member, and the coupling speed is set to a rotational speed of the driven member at which a centrifugal force applied to the coupling member balances a biasing force of the biasing member.

6. The engine-starting apparatus as in claim 5, wherein:

the coupling member includes a plurality of coupler pieces; and the separating speed is defined as a rotational speed of the driving member at which a first predetermined number of the coupler pieces are separated from the driving member, and the coupling speed is defined as a rotational speed of the driven member at which a second predetermined number of the coupler pieces contact the driving member.

7. The engine-starting apparatus as in any one of claims 1–3, wherein:

the electric motor is switched on when the rotational speed of the driven member becomes equal to or lower than the coupling speed, under a situation where the internal combustion engine stalls after it has been once cranked, and the electric motor is still rotating by its inertia after it has been switched off.

8. The engine-starting apparatus as in any one of claims 1–3, wherein:

the electric motor is switched on when the rotational speed of the driven member becomes equal to or lower than the coupling speed, under a situation where the internal combustion engine is still rotating by its inertia after its operation has been terminated according to predetermined conditions.

9. The engine-starting apparatus as in any one of claims 1–3, wherein:

the overrunning clutch and the electric motor are integrally formed as a unitary body, and the driven member of the overrunning clutch is adapted to rotate the crankshaft of the internal combustion engine.

10. The engine-starting apparatus as in any one of claims 1–3, wherein:

the overrunning clutch is built together with the internal combustion engine, and the driving member is adapted to be rotated by the electric motor.

* * * * *